US007607861B2

(12) United States Patent
Kang

(10) Patent No.: US 7,607,861 B2
(45) Date of Patent: Oct. 27, 2009

(54) CONNECTION STRUCTURE OF PLATE-TYPE VERTICAL DRAIN AND CIRCULAR HORIZONTAL DRAINPIPE AND METHOD OF CONSTRUCTING HORIZONTAL DRAIN LAYER IN SOFT GROUND USING THE SAME

(76) Inventor: Soo Yong Kang, 13-1201, New Town Apt., Bisan 3-dong, Dongan-gu, Anyang-si, Gyeonggi-do 431-737 (KR)

( * ) Notice: Subject to any disclaimer, the term of this patent is extended or adjusted under 35 U.S.C. 154(b) by 0 days.

(21) Appl. No.: 12/151,772

(22) Filed: May 8, 2008

(65) Prior Publication Data

US 2008/0298895 A1 Dec. 4, 2008

(30) Foreign Application Priority Data

May 31, 2007 (KR) ..... 10-2007-0053363

(51) Int. Cl.
*E02B 11/00* (2006.01)

(52) U.S. Cl. ..... 405/43; 210/170.01; 405/50

(58) Field of Classification Search ..... 405/36, 405/43, 45, 50, 51; 210/170.01
See application file for complete search history.

(56) References Cited

U.S. PATENT DOCUMENTS

2006/0133897 A1* 6/2006 Allard et al. ..... 405/43
2006/0188344 A1* 8/2006 Boys ..... 405/284
2007/0243019 A1* 10/2007 Baker ..... 405/36

FOREIGN PATENT DOCUMENTS

JP 1992-254610 9/1992
KR 1020000074033 12/2000
KR 10-0390285 10/2003

* cited by examiner

*Primary Examiner*—Tara Mayo-Pinnock
(74) *Attorney, Agent, or Firm*—Abelman, Frayne & Schwab

(57) ABSTRACT

A connection structure of plate type vertical drains and a circular horizontal drainpipe and a method of constructing a horizontal drain layer in soft ground using the same. The plate type vertical drains are coupled to the circular horizontal drainpipe using cylindrical fitters, so that excess pore water can be easily drained from underground even if the horizontal drain layer is constructed by pouring soil instead of sand, thereby reducing construction costs and a construction period.

7 Claims, 6 Drawing Sheets

CONNECTION STRUCTURE OF PLATE-TYPE VERTICAL DRAIN AND CIRCULAR HORIZONTAL DRAINPIPE AND METHOD OF CONSTRUCTING HORIZONTAL DRAIN LAYER IN SOFT GROUND USING THE SAME

CROSS REFERENCE TO RELATED APPLICATION(S)

This application claims the benefit of Korean Patent Application No. 10-2007-0053363, filed on May 31, 2007, entitled "CONNECTION STRUCTURE OF PLATE-TYPE VERTICAL DRAIN AND CIRCLE-TYPE HORIZONTAL DRAINPIPE AND THE METHOD OF CONSTRUCTING FOR HORIZONTAL DRAIN LAYER FOR TREATING WEAK GROUND USING THEM," which is hereby incorporated by reference in its entirety into this application.

BACKGROUND OF THE INVENTION

1. Field of the Invention

The present invention relates to a connection structure of plate type vertical drains and a circular horizontal drainpipe and a method of constructing a horizontal drain layer in soft ground using the same. More particularly, the present invention relates to a fitting type of connection structure of plate type vertical drains and a circular horizontal drainpipe and a method of constructing a horizontal drain layer in soft ground using the same, in which the plate type vertical drains are coupled to the circular horizontal drainpipe using cylindrical fitters, so that excess porewater can be easily drained from underground even if the horizontal drain layer is constructed by pouring soil instead of sand, thereby saving construction costs and reducing the construction period.

2. Description of the Related Art

Soft ground is generally composed of clay soil, located in reclaimed land, the beach, the riverside, sloughs, swamplands and so on, and does not provide a sufficient amount of support to serve as a foundation for a building. When a building is directly constructed on the soft ground, the foundation may collapse, or major consolidation and settlement may occur.

As an approach to improve the soft ground, there is proposed a vertical drain method, in which a plurality of vertical drains is artificially constructed in the soft clay ground in order to decrease the draining distance, thereby promoting the consolidation of the ground.

According to the conventional vertical drain method, a horizontal drain layer is formed on the top surface of the soft ground, followed by constructing plate type vertical drains in the soft ground, and then cover soil is laid thereon, so that excess porewater pressure corresponding to the load of the cover soil is created in the soft ground, thereby guiding excess porewater from underground to drain to sand of the horizontal drain layer through the plate type vertical drains.

Therefore, in order to drain porewater from the soft ground treatment consolidation method, it is important to ensure the constructability of the plate type vertical drains. However, the drainability of the horizontal drain layer is regarded as the most important factor.

In the conventional vertical drain method, as material providing the drainability of the horizontal drain layer, sand deposited on a river or sea bed or crushed sand is essentially selected.

That is, a geosynthetic mat is laid on the top surface of the soft ground in order to reinforce the ground for an embankment, and a sand mat for horizontal drainage is laid thereon at a thickness of about 50 to 100 cm, so that excess porewater from the plate type vertical drains can be guided to and drained through the sand mat by the hydraulic gradient.

However, when a large area of soft ground has to be reinforced, some of the plate type vertical drains are far away from the outer circumference of the sand mat, and consolidation settlement takes place. Restriction/deformation may occur in the cross section of the sand mat, or foreign materials (i.e. the organic soil) may penetrate into the sand mat, so that the sand mat may gradually lose its normal horizontal drainage capability.

This increases the resistance of the sand mat against excess porewater from underground, thereby producing side effects such as delayed consolidation due to degraded permeability and the behavior of residual porewater pressure. Accordingly, residual settlement becomes greater than estimated.

Furthermore, the settlement of the central area of the ground causes excess porewater to accumulate in the sand mat instead of being drained therethrough. Thus, sump pumps and pipelines are additionally required in order to forcibly drain accumulated porewater out of the central area.

In the vertical drain method for treating soft grounds, which uses sand for the horizontal drain layer, most of the sand mat of the horizontal drain layer is below ground water level. The sand mat is deformed by the penetration of foreign materials and the reduction of the cross section and thus its permeability is degraded, thereby causing delayed consolidation and residual consolidation in a great amount.

Furthermore, since the supply of natural sand is being gradually exhausted, the development of new sources of sand is required. In connection with this, however, environmental damage is expected, and the cost of sand is sharply rising, thereby increasing construction costs.

As an approach to overcome these problems, Korean Patent Publication No. 2000-0074033 proposes a method of reinforcing soft ground without the use of sand. According to this method, vertical drains are constructed in a soft ground, a horizontal drainpipe is connected to the vertical drains using T-shaped connectors, and a counterbalance process is performed thereon, so that excess porewater can be drained from underground without the use of sand.

In this conventional method, however, the T-shaped connectors are provided to pipes of the vertical drains, and each of the horizontal drainpipes is cut by a corresponding length. Accordingly, a worker has to calculate respective lengths and cut respective horizontal drainpipes based upon the calculated lengths.

Since each of the cut horizontal drainpipes has to be inserted into a corresponding one of the T-shaped connectors, a large number of workers is also required. This acts as a factor that increases construction costs, possibly prolonging the construction period.

Furthermore, since only an end portion of the horizontal drainpipe is inserted into the T-shaped connector, the horizontal drainpipe may be easily removed from the T-shaped connector in the event of settlement of the soft ground. This may lead to a connection defect, thereby degrading the ability to drain excess porewater.

Japanese Patent Publication No. 1992-254610 also discloses a method of improving soft ground, by which a horizontal drainpipe is directly connected to a vertical drainpipe to drain excess porewater from underground. However, construction thereof is difficult since a welding process or an auxiliary drain is required to directly connect the horizontal drainpipe to the vertical drainpipe.

Since the horizontal drainpipe, made of steel is directly connected to the vertical drainpipe, the horizontal drainpipe and the vertical drainpipe may be disconnected from each other, or may be broken in the worse case, thereby hindering drainage. In some cases, additional construction for repair is subsequently required.

Furthermore, Korean Patent No. 0390285 discloses a method of promoting dewatering of soft ground using a combination of a cylindrical drain and a plate type drain. In this method, a cylindrical drain having a filtering corrugated structure is constructed in an upper level area of a soft ground, and a plate type drain is constructed in a lower level area of the soft ground, and is coupled to the cylindrical drain using a coupling, and a Styrofoam mat is used in place of sand.

In this conventional method, however, since the cylindrical drain is coupled, via the coupling, to the top portion of the plate type drain underground, constructability is degraded. Furthermore, since a band strap is used to bind the drains, the coupling may be easily loosened.

Moreover, the Styrofoam mat used as a horizontal drain layer makes it difficult to flexibly cope with the settlement of the soft ground, and additional materials such as an EPS mat and nonwoven cloth, laid on the top of the Styrofoam mat, complicate construction and may also raise overall costs.

SUMMARY OF THE INVENTION

The present invention has been made to solve the foregoing problems with the prior art, and therefore the present invention can provide a construction without using sand, in the interest of environmental protection, and can also easily, simply and securely couple plate type vertical drains to a circular horizontal drainpipe, thereby saving construction costs, reducing the construction period and improving construction quality.

The present invention also provides a connection structure of plate type vertical drains and a circular horizontal drainpipe, by which a drain system is constructed using soil in place of sand, and coupling plate type vertical drains to a circular horizontal drainpipe using cylindrical fitters in order to maximize the drainage capability of soil, so that excess porewater can be drained from underground.

The present invention also provides a cylindrical fitter for connecting a plate type vertical drain to a circular horizontal drainpipe, by which the plate type vertical drain can be quickly and securely coupled to the circular horizontal drainpipe, and by which the construction period can be reduced and reasons for repair can be eliminated in advance.

The present invention also provides a method of constructing a horizontal drain layer in soft ground using a connection structure of plate type vertical drains and a circular horizontal drainpipe, by which excess underground porewater can be guided and drained through the circular horizontal drainpipe directly after passing through the plate type vertical drain, thereby preventing the degradation of the drainability of soil, which is used as a horizontal drain layer in place of sand.

According to an aspect of the present invention, there is provided a connection structure of plate type vertical drains and a circular horizontal drainpipe. The connection structure includes the plate type vertical drains arrayed in soft ground to drain excess porewater from underground; a connector provided at one end portion of each of the plate type vertical drains, which is exposed outside, the connector having an inner coupling space; the circular horizontal drainpipe coupled in the coupling space, wherein the circular horizontal drainpipe comprises a corrugated structure and has water holes; and a fitter fitted on the connector, and having a guide cut in a longitudinal direction thereof, wherein the connector is wrapped on and closely fastened to the circular horizontal drainpipe.

According to another aspect of the present invention, there is provided a method of constructing a horizontal drain layer in soft ground using a connection structure of plate type vertical drains and a circular horizontal drainpipe. The method includes procedures of:

laying a geosynthetic material on the top surface of the soft ground in order to secure trafficability by construction machines, and pouring soil on the geosynthetic material, thereby forming a molding layer (platform fill);

arraying the plate type vertical drains for guided draining of porewater, each of which has vertical water channels and reinforcing ribs, is wrapped in absorbent nonwoven cloth (geosynthetic filter mat), and has a connector at one end thereof, which is exposed outside, the connector having an inner coupling space;

fitting cylindrical fitters, each of which has a guide cut along a longitudinal direction thereof, on the circular horizontal drainpipe, which comprises a corrugated structure and has water holes;

coupling the circular horizontal drainpipe having the cylindrical fitter fitted thereon to the coupling spaces of the connectors, which are exposed outside, by spreading respective connectors;

driving the cylindrical fitters to proceed along the circular horizontal drainpipe, so that the plate type vertical drains are coupled to the circular horizontal drainpipe using the guide of respective fitters, and the connectors are wrapped on and closely fastened to the circular horizontal drainpipe; and pouring soil on the top surface of the molding layer, thereby forming a horizontal drain layer.

It is preferable that the horizontal drain layer is laid on ground water level or on the surface if possible, after target settlement. If not, it is archived by increasing the load of the cover soil.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PRESENT INVENTION

The present invention will now be described more fully with reference to the accompanying drawings, in which exemplary embodiments of the present invention are shown.

Figure 1:
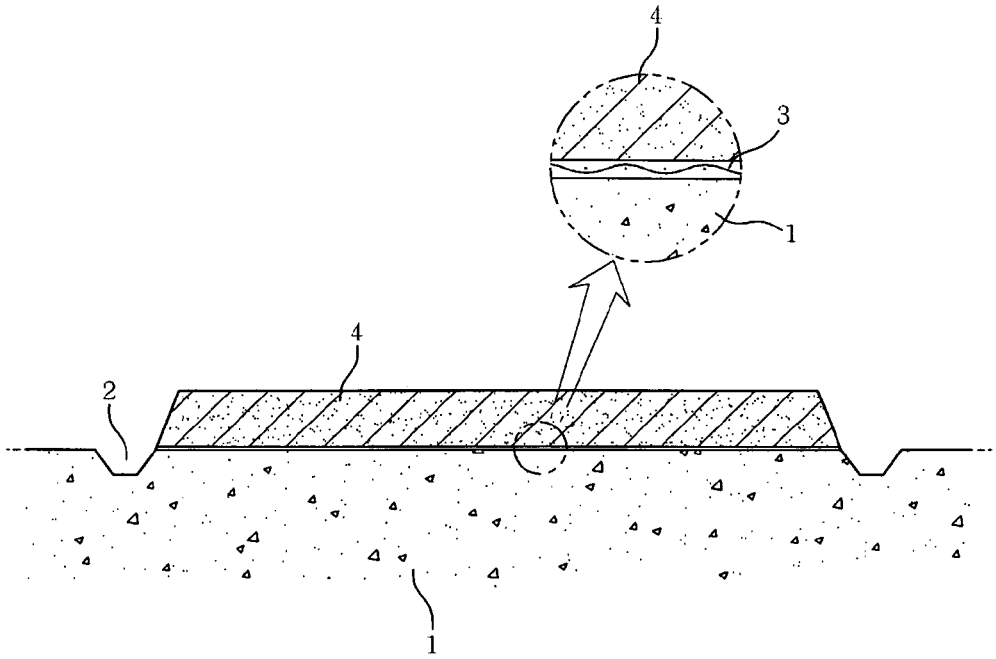
FIG. 1 is a cross sectional view illustrating an initial construction stage according to the present invention.

FIG. 1 is a cross sectional view illustrating an initial construction stage according to the present invention. Referring to FIG. 1, a geosynthetic mat and a molding layer are formed on the surface of soft ground, and outside drains for draining excess porewater from underground are formed in the outer circumference of the soft ground.

Figure 2:
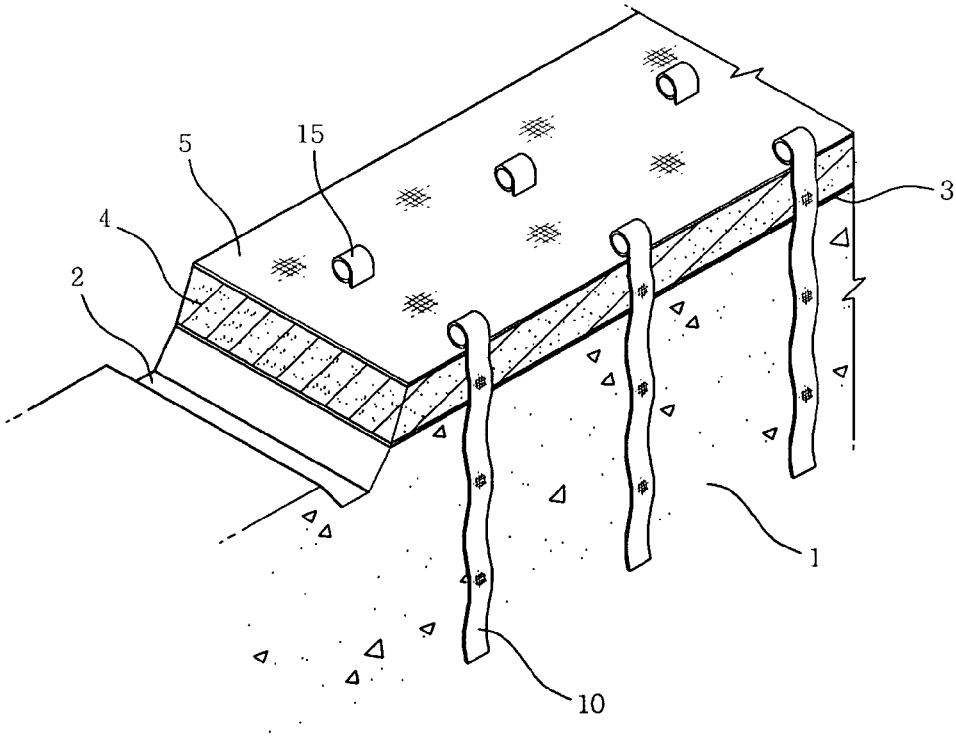
FIG. 2 is a perspective view illustrating a construction stage of plate type vertical drains according to the present invention.

FIG. 2 is a perspective view illustrating a construction stage of plate type vertical drains according to the present invention, in which plate type vertical drains for guiding and draining excess porewater from underground are arrayed in the soft ground.

Figure 3:
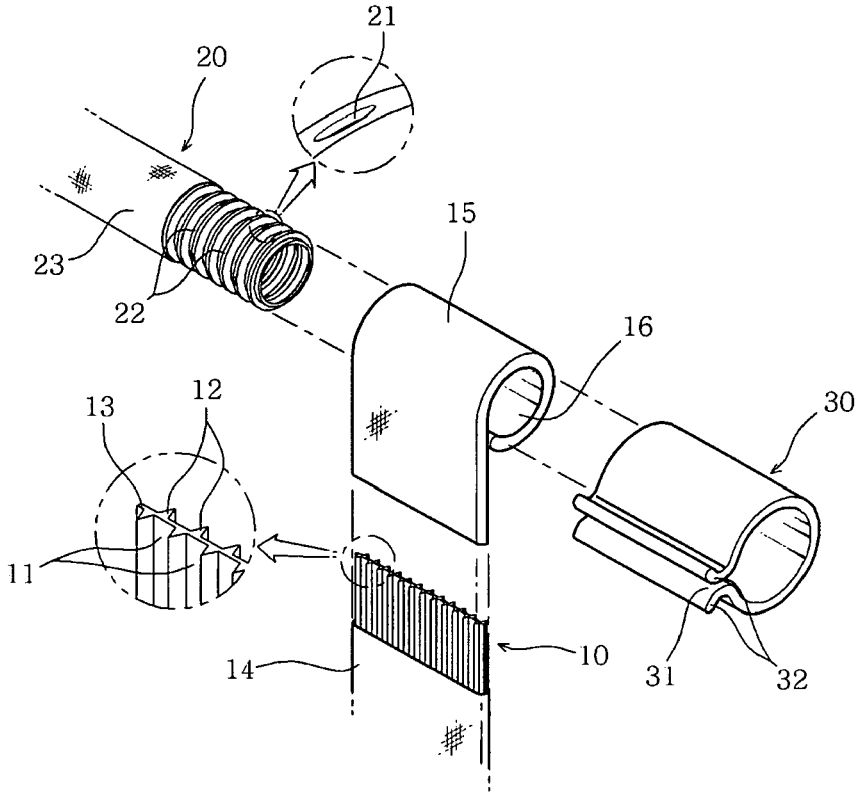
FIG. 3 is an exploded perspective view illustrating an embodiment of a cylindrical fitter for coupling between a plate type vertical drain and a circular horizontal drainpipe.

FIG. 3 is an exploded perspective view illustrating an embodiment of a cylindrical fitter for coupling between a plate type vertical drain and a circular horizontal drainpipe, in which a guide and bent portions for helping open the guide are formed in the periphery of the cylindrical fitter by cutting.

Figure 4:
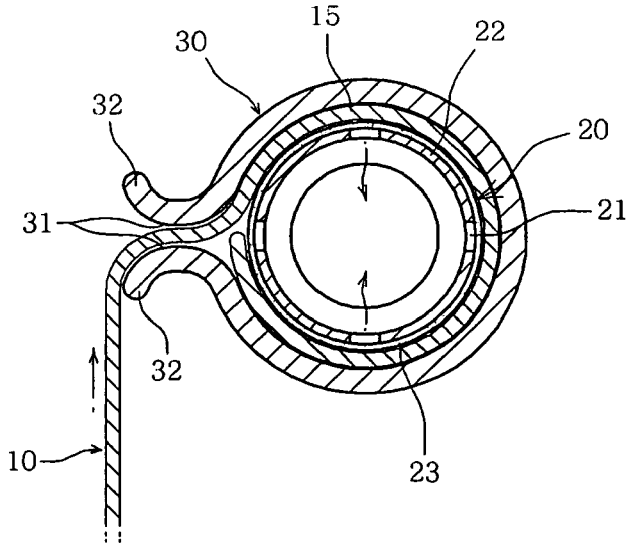
FIG. 4 is a cross sectional view illustrating a coupled state of the plate type vertical drain and the circular horizontal drainpipe using the circular fitter shown in FIG. 3.

FIG. 4 is a cross sectional view illustrating a coupled state of the plate type vertical drain and the circular horizontal drainpipe using the circular fitter shown in FIG. 3. FIG. 4 shows, in a partially enlarged view, the circular horizontal drainpipe coupled to a coupling space of the plate type vertical drain using the cylindrical fitter, which includes the guide and the bent portions.

Figure 5:
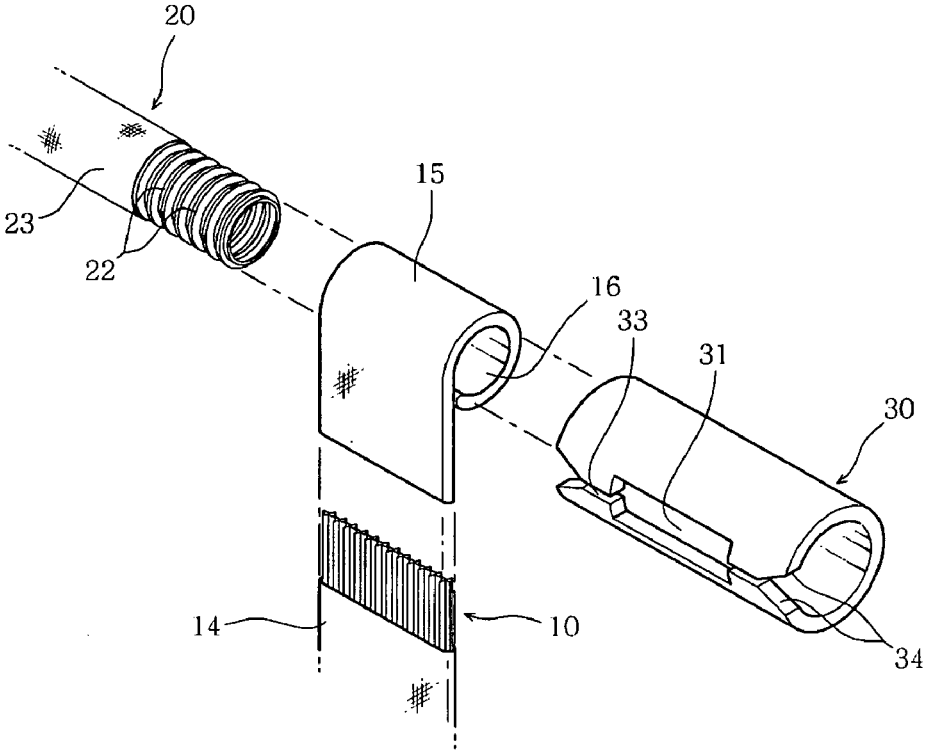
FIG. 5 is an exploded perspective view illustrating another embodiment of the cylindrical fitter for coupling between a plate type vertical drain and a circular horizontal drainpipe.

FIG. 5 is an exploded perspective view illustrating another embodiment of the cylindrical fitter for coupling between a plate type vertical drain and a circular horizontal drainpipe, in which a guide, roundness-maintaining portions and entrances are formed in the periphery of the cylindrical fitter by cutting.

Figure 6:
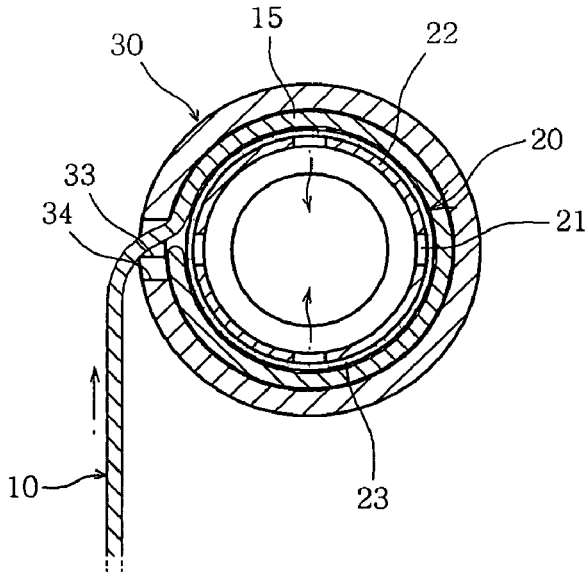
FIG. 6 is a cross sectional view illustrating a coupled state of the plate type vertical drain and the circular horizontal drainpipe using the circular fitter shown in FIG. 5.
Figure 7:
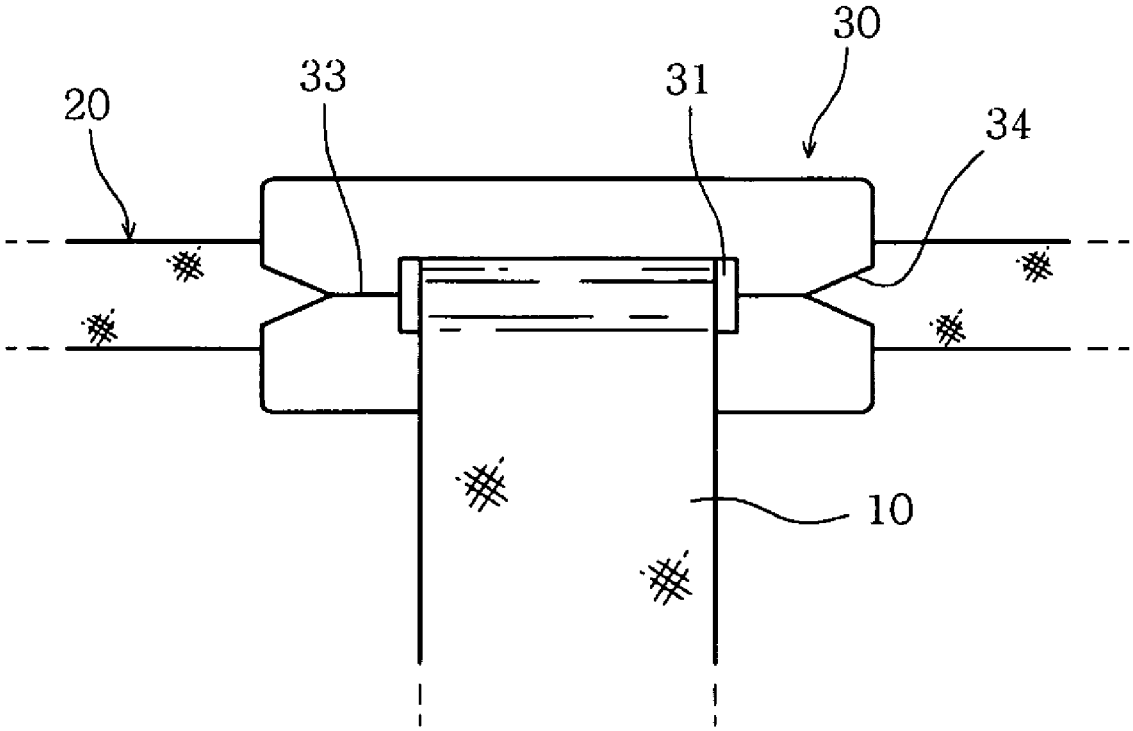
FIG. 7 is a configuration view of FIG. 6.

FIG. 6 is a cross sectional view illustrating a coupled state of the plate type vertical drain and the circular horizontal drainpipe using the circular fitter shown in FIG. 5, and FIG. 7 is a configuration view of FIG. 6. FIGS. 6 and 7 show, in a partially enlarged view, the circular horizontal drainpipe coupled to a coupling space of the plate type vertical drain using the cylindrical fitter, which includes the guide, the roundness-maintaining portions and the entrances.

Figure 8:
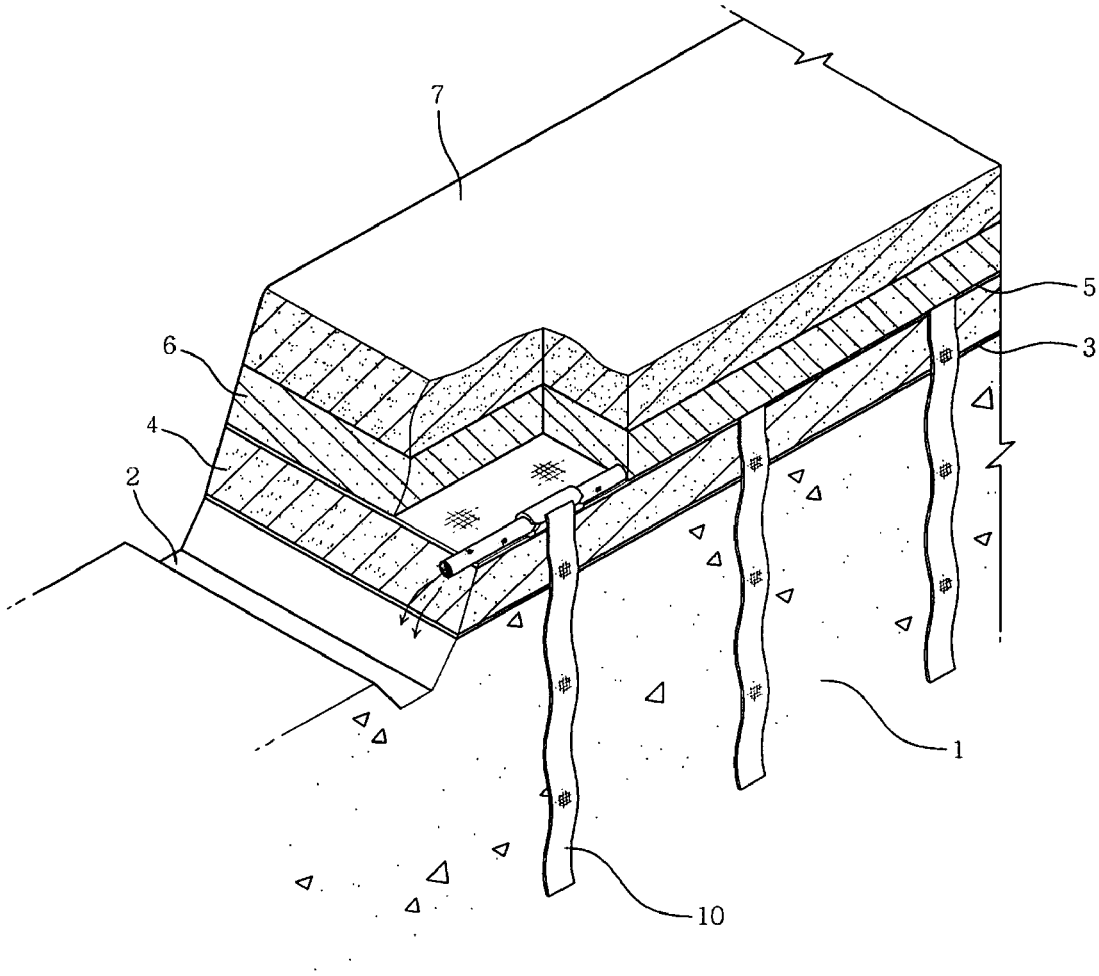
FIG. 8 is a perspective view illustrating a constructed state of the horizontal drain layer according to the present invention.

FIG. 8 is a perspective view illustrating a constructed state of the horizontal drain layer according to the present invention. Referring to FIG. 8, the horizontal drain layer is formed by pouring soil on the top of the molding layer, in which the plate type vertical drains and the circular horizontal drainpipe are arrayed and constructed.

Figure 9:
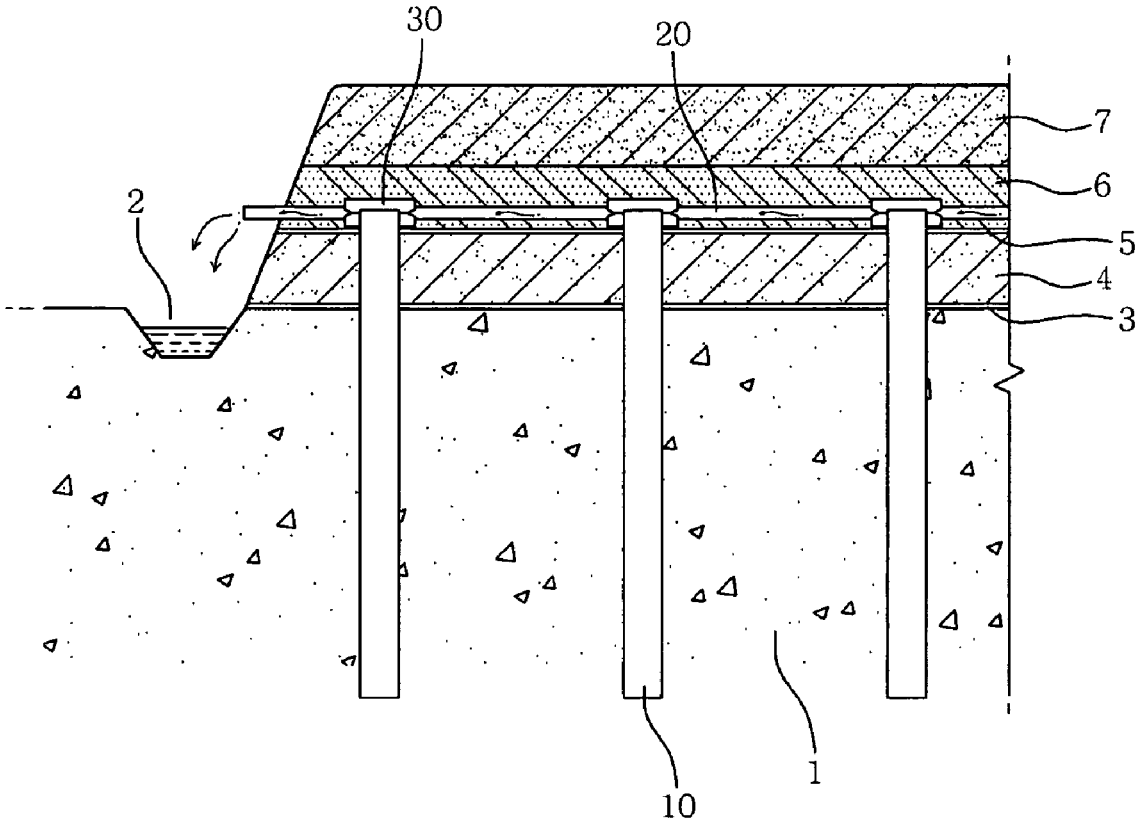
FIG. 9 is a cross sectional view illustrating a draining state using the plate type vertical drains and the circular horizontal drainpipe according to the present invention.

FIG. 9 is a cross sectional view illustrating a draining state using the plate type vertical drains and the circular horizontal drainpipe according to the present invention. Referring to FIG. 9, the plate type vertical drains and the circular horizontal drainpipe cooperate to drain excess porewater from underground to the outside drains in the outer circumference of the soft ground.

As shown in FIG. 1, in order to construct a horizontal drain layer 6 in soft ground 1, outside drains 2, which drain excess porewater, are first formed in the outer circumference of the soft ground 1.

The initial construction stage according to the present invention is carried out to ensure the trafficability of construction machines, which construct plate type vertical drains 10 and circular horizontal drainpipes 20 in the soft ground 1 having the outside drains 2. In this stage, a ground-reinforcing geosynthetic mat 3 is laid on the surface of the soft ground 1.

soil and sand are laid on the top of the ground-reinforcing geosynthetic mat 3, thereby forming a molding layer 4. A nonwoven mat 5 is laid on the top of the molding layer 4, to facilitate construction by the machines.

That is, the nonwoven mat 5 is laid on the top of the molding layer 4 according to the amount that the soft ground 1 is estimated to settle. Alternatively, the nonwoven mat 5 need not be provided when the initial construction itself can facilitate construction by the construction machines since the estimated amount of the consolidation settlement is not great.

As shown in FIG. 2, in the construction stage of plate type vertical drains according to the present invention, an array of plate type vertical drains 10 is constructed in the molding layer 4 on the top surface of the soft ground 1 in order to drain excess porewater from underground.

As shown in FIG. 3, a plate type vertical drain 10, constructed in the soft ground through this construction stage, includes a plate type drain body 13 and water-absorbent nonwoven cloth 14. In order to drain excess porewater from underground, the plate type drain body 13 has vertical water channels 11 and reinforcing ribs 12, which repeat at a predetermined interval, and the water-absorbent nonwoven cloth 14 is wrapped on the plate type drain body 13.

When the plate type vertical drain 10 is constructed by being poured inside the soft ground 1, the pressure accumulated by the reinforcing ribs 12 can prevent the plate type vertical drain 10 from being bent or deformed, and can also prevent the vertical water channels 11 from being clogged by the strong soil pressure acting thereon. Hence, this structure can help excess porewater drain from underground.

FIGS. 3 and 4 also show a connector 15, which is formed at the end portion of the plate type vertical drain 10.

The end portion of the plate type vertical drain 10, exposed from the soft ground 1, is bent 360 degrees, thereby forming the connector 15. The connector 15, bent 360 degrees, forms an inner coupling space 16, which functions to couple a circular horizontal drainpipe 20, which will be described later, to the plate type vertical drain 10.

The circular horizontal drainpipe 20, fastened to the coupling space 16, acts to drain porewater to the outside drains 2 in the outer circumference of the soft ground 1 when porewater is introduced from underground to the surface of the soil through the plate type vertical drain 10.

For this, the circular horizontal drainpipe 20 of the present invention has a plurality of water holes 21 formed in the circumference thereof. The water holes 21 drain excess porewater, introduced through the plate type vertical drain 10, to the outside drains 2 in the outer circumference of the soft ground 1.

The circular horizontal drainpipe 20, which is provided at the site, has a corrugated structure composed of repeating corrugated segments 22. The corrugated structure of the corrugated segments 22 prevents the circular horizontal drainpipe 20 from being bent or cut when consolidation settlement occurs in part of the soft ground 1.

Desirably, in order to ensure the convenience of delivery and construction, the circular horizontal drainpipe 20 is provided in the form of a roll, which is untied and constructed at the site. Hence, the circular horizontal drainpipe 20 is generally molded of soft synthetic resin.

Furthermore, a fibrous material 23 is wrapped around the circular horizontal drainpipe 20, which has the water holes 21 in the corrugated structure, in order to introduce excess porewater from underground, introduced through the plate type vertical drain 10, to the water holes 21.

In the case where the circular horizontal drainpipe 20 is provided, as shown in FIG. 4, excess porewater from the water, introduced through the plate type vertical drain 10, is fed into the circular horizontal drainpipe 20 through the water holes 21, and then drains to the outside drains 2 in the outer circumference of the soft ground 1.

When consolidation settlement occurs in part of the soft ground 1 in the process, the circular horizontal drainpipe 20 may be partially bent. However, the corrugated structure prevents the circular horizontal drainpipe 20 from being completely bent or cut, so that the circular horizontal drainpipe 20 does not lose the draining function.

In the fitter connection stage of the present invention, before the circular horizontal drainpipe 20 is fastened into the coupling space 16 of the plate type vertical drain 10, a cylindrical fitter 30 is inserted into the circular horizontal drainpipe 20 in order to maintain the fastened state.

Here, the cylindrical fitter 30 may be widened for fastening in the state in which the circular horizontal drainpipe 20 is fastened to the coupling space 16 of the plate type, vertical drain 10. However, excessive time and force are required to widen the cylindrical fitter 30, thereby degrading workability.

Thus, according to the present invention, a plurality of the cylindrical fitters 30 is first inserted into the circular horizontal pipe 20 depending on the interval of a plurality of the plate type vertical drains 10, and then the circular horizontal pipe 20 is fixedly fastened to the plate type vertical drains 10.

The cylindrical fitter 30, which maintains the fastened state of the circular horizontal pipe 20, will be described more fully below:

The cylindrical fitter 30 has a hollow inner space to receive the circular horizontal drainpipe 20 therein. Part of the periphery of the cylindrical fitter 30 is cut along the length thereof, forming a guide 31. The cylindrical fitter 30 is fixedly fitted around the plate type vertical drain 10 via the guide 31.

Desirably, the guide 31 of the cylindrical fitter 30 has an opening, the dimension of which is equal to or a maximum of twice the thickness of the plate type vertical drain 10, so that the guide 31 does not have an effect on the guided drainage of pore water through the plate type vertical drain 10.

More desirably, as shown in FIG. 3, the guide 31 is formed in the periphery of the cylindrical fitter 30 by cutting along the length thereof, and bent portions 32 are formed at the end of the guide 31 by bending in order to help the guide 31 be more easily opened.

In the procedure of fitting the fitter 30 on the plate type vertical drain 10, a worker can widen the opening of the guide 31 by slightly spreading the bent portions 32, so that the fitter 30 can be easily fitted on the plate type vertical drain 10.

As a more desirable structure, as shown in FIG. 5, the cylindrical fitter 30 has a guide 31, which is formed in the central portion of the periphery by cutting along the length of the fitter 30, and roundness-maintaining portions 33 and entrances 34, which are symmetrically formed on both sides of the guide 31 by cutting along the length of the fitter 30.

The cylindrical fitter 30 having this structure can prevent the following problems. After the circular horizontal drainpipe 20 is fixedly fastened to the plate type vertical drains 10 using the cylindrical fitters 30, the horizontal drain layer 6 is formed by molding soil on the ground. When the pressure of the soil forming the horizontal drain layer 6 is applied to the cylindrical fitter 30, the guide 31 may be partially or entirely closed, thereby degrading the guided drainability for porewater, which is obtained through the plate type vertical drains 10.

This problem can be prevented by the roundness-maintaining portions 33, which are formed on both sides of the guide 31 of the cylindrical fitter 30. As shown in FIG. 7, even when the pressure of soil of the horizontal drain layer 6 is applied, the roundness-maintaining portions 33 contact each other before the guide 31 closes the opening, thereby preventing the guided drainability for porewater, obtained through the plate type vertical drains 10, from being degraded.

Furthermore, the entrances 34 extending from the roundness-maintaining portions 33 to the opposite longitudinal ends of the cylindrical fitter 30 are wedge-shaped, with a predetermined angle of about 45 degrees therebetween, so that the cylindrical fitter 30 can be easily and rapidly fitted on and fixed to the plate type vertical drain 10.

The length of the cylindrical fitter 30 is set to be larger than the plate type vertical drain 10 by a ratio of about 1.5:1. When fixedly fitted, the plate type vertical drain 10 extends beyond the opposite longitudinal ends of the cylindrical fitter 30 to restrain the connecting portion 15, which is at the end portion of the plate type vertical drain 10, so that the connecting portion 15 does not spread due to the elastic force thereof.

In addition, the cylindrical fitter 30, which is longer than the width of the plate type vertical drain 10, can additionally prevent the connecting portions between the plate type vertical drain 10 and the circular horizontal drainpipe 20 from being compressively strained by the load of soil.

The cylindrical fitter 30, as described above, is formed of a predetermined material including synthetic resin and metal, so that it can quickly restore its original shape after being widened and fixedly fitted on the plate type vertical drain 10.

In the construction stage of the circular horizontal drainpipe according to the present invention, the connectors 15 exposed above the molding layer 4 are spread and the circular horizontal drainpipe 20 having the cylindrical fitter 30 fitted thereon is fastened into the coupling spaces 16 of the plate type vertical drains 10.

In this process, it is desirable that the cylindrical fitters 30 be interposed between the plate type vertical drains 10, which are arrayed in the molding layer 4, and that each of the cylindrical fitters 30 be placed adjacent to a corresponding one of the cylindrical fitters 30, so that the worker can quickly fit the cylindrical fitters 30 on the respective plate type vertical drains 10.

It is more desirable that the construction stage of the circular horizontal drainpipes be carried out in association with a drain connecting stage, which will be described later.

This is because the connector 15, provided at the end portion of the plate type vertical drain 10, is bent 360 degrees to form, therein, the coupling space 16 for coupling with the circular horizontal drainpipe 20. Unless it is provided with an additional fixing member, the connector 15 is continuously applied with a force for spreading it.

Hence, it is desirable that the drain connecting stage be carried out immediately after the circular horizontal drainpipe 20 is fastened to the plate type vertical drain 10 through the construction stage of the circular horizontal drainpipe, so that the connector 15 can be wrapped on and closely fastened to the circular horizontal drainpipe 20.

In the drain connecting stage for this, as shown in FIGS. 3 to 7, the fitter 30 proceeds along the circular horizontal drainpipe 20, coupling the plate type vertical drain 10 and the circular horizontal drainpipe 20 with each other through the guide 31. Then, the connector 15 is wrapped on and closely fastened to the circular horizontal drainpipe 20, thereby causing excess porewater from underground to drain to the outside drains 2 in the outer circumference of the soft ground 1.

That is, through this drain connecting stage, the cylindrical fitter 30 proceeds to be fixedly fit on the plate type vertical drain 10 using the longitudinally-cut guide 31, so that the connector 15 at the end of the plate type vertical drain 10 is wrapped on and closely fastened to the circular horizontal drainpipe 20.

The process of fitting and fixing the cylindrical fitter 30 is the same as above, and thus will not described further.

The worker repeatedly carries out the above-mentioned drain connecting stage on respective plate type vertical drains 10, which are arrayed in the molding layer 4, so that the plate type vertical drains 10 are closely coupled to the circular horizontal drainpipe 20.

In the finishing stage of the present invention, as shown in FIG. 8, soil is poured on the top of the molding layer 4, in which the plate type vertical drains 10 are coupled to the circular horizontal drainpipe 20, thereby forming the horizontal drain layer 6, so that the plate type vertical drains 10 and the circular horizontal drainpipe 20 are buried in the horizontal drain layer 6.

The horizontal drain layer 6, constructed in this finishing stage, is poured to a thickness of about 50 to 100 cm, so that the plate type vertical drains 10 are not exposed outside. However, this is not intended to limit the present invention since the thickness can be adjusted according to the state of the soft ground 1 and the construction site.

Soil is piled up on top of the horizontal drain layer 6 to form a cover layer 7, so that excess porewater pressure corresponding to the load of the cover layer 7 occurs inside the soft ground. Owing to this pressure, excess porewater from underground is absorbed by the absorbent nonwoven cloth 14 surrounding the plate type vertical drains 10.

As shown in FIG. 9, excess porewater, absorbed by the absorbent nonwoven cloth 14, rises along the vertical water channels 11, finally reaching the connectors 15. Then, excess porewater is absorbed by the fibrous material 23 wrapped on the circular horizontal pipe 20, which is closely coupled to the connectors 15.

Excess porewater absorbed by the fibrous material 23 is supplied to the circular horizontal drainpipe 20 through the water holes 21 thereof, is carried through the circular horizontal drainpipe 20, and finally drains to the outside drains 2 in the outer circumference of the soft ground 1.

According to the present invention as set forth above, the drain system, which is constructed by coupling the plate type vertical drains to the circular horizontal drainpipe using the cylindrical fitters, can prevent the drainability of the circular horizontal drainpipe from degrading even in the case of consolidation settlement, so that excess porewater can be effectively drained from underground even if soil is used for the horizontal drain layer in place of sand.

Hence, the use of soil in place of sand can greatly reduce construction costs, and can also reduce the construction period while improving quality.

Furthermore, the cylindrical fitters for closely coupling the circular horizontal drainpipe to the plate type vertical drains can be connected in advance to the circular horizontal drainpipe, and can then proceed along the circular horizontal drainpipe to be fitted thereon. This, as a result, makes it possible for a small number of workers to carry out the coupling operation, thereby remarkably improving work efficiency.

Moreover, the present invention provides a structure capable of withstanding the pressure of soil in order to prevent the drainage capability of the plate type vertical drains from degrading or being lost.

While the present invention has been described with reference to the particular illustrative embodiments and the accompanying drawings, it is not to be limited thereto, but will be defined by the appended claims. It is to be appreciated that those skilled in the art can substitute, change or modify the embodiments in various forms without departing from the scope and spirit of the present invention.

What is claimed is:

1. A connection structure of plate type vertical drains and a circular horizontal drainpipe, comprising:

the plate type vertical drains, arrayed in soft ground vertically about a surface of the soft ground to drain excess pore water from underground, wherein the plate type vertical drains includes a plate type drain body having vertical water channels and reinforcing ribs which alternately repeat at an interval and a water-absorbent nonwoven cloth wrapping on the plate type drain body;

a connector integrally provided at an end portion of each of the plate type vertical drains, which is exposed outside, the connector having an inner coupling space;

the circular horizontal drainpipe inserted into the coupling space, wherein the circular horizontal drainpipe is formed as a corrugated structure and has a plurality of water holes in circumference surface thereof and a fibrous material wrapping around the circular horizontal drainpipe; and a cylindrical fitter fitted on the connector, and having a guide cut along a longitudinal direction thereof periphery, wherein the connector is wrapped on and closely fastened to the circular horizontal drainpipe.

2. The connection structure according to claim 1, wherein the guide is cut in a peripheral portion of the cylindrical fitter along the longitudinal direction thereof, and bent portions for helping open the guide are provided at ends of the guide.

3. The connection structure according to claim 2, wherein the cylindrical fitter extends longer than a width of each of the plate type vertical drains.

4. The connection structure according to claim 1, wherein the guide is cut in a central portion of the periphery of the cylindrical fitter along the longitudinal direction thereof, and roundness-maintaining portions and entrances are symmetrically formed on both sides of the guide by cutting along the longitudinal direction of the cylindrical fitter.

5. The connection structure according to claim 4, wherein the cylindrical fitter extends longer than a width of each of the plate type vertical drains.

6. The connection structure according to claim 1, wherein the cylindrical fitter extends longer than a width of each of the plate type vertical drains.

7. A method of constructing a horizontal drain layer in soft ground using a connection structure of plate type vertical drains and a circular horizontal drainpipe, the method comprising:

laying a geosynthetic material on a top surface of the soft ground in order to ensure ease of trafficability by construction machines, and pouring soil on the geosynthetic material, thereby forming a molding layer(platform fill);

arraying the plate type vertical drains for guided draining of pore water, each of which has vertical water channels and reinforcing ribs, is wrapped in absorbent nonwoven cloth, and has a connector at an end thereof, which is exposed outside, the connector having an inner coupling space;

fitting cylindrical fitters, each of which has a guide cut in a longitudinal direction thereof, on the circular horizontal drainpipe, which comprises a corrugated structure and has water holes;

coupling the circular horizontal drainpipe having the cylindrical fitter fitted thereon to the coupling spaces of the connectors, which are exposed outside, by spreading respective connectors;

driving the cylindrical fitters to proceed along the circular horizontal drainpipe, so that the plate type vertical drains are coupled to the circular horizontal drainpipe using the guide of respective fitters, and the connectors are wrapped on and closely fastened to the circular horizontal drainpipe; and pouring soil on a top surface of the molding layer(platform fill), thereby forming a horizontal drain layer.

* * * * *